United States Patent [19]

McDonald et al.

[11] Patent Number: 4,619,622

[45] Date of Patent: Oct. 28, 1986

[54] SWIM SAFE PLAY SUIT

[76] Inventors: Edith N. McDonald; George Spector, both of 233 Broadway, Rm. 3615, New York, N.Y. 10007

[21] Appl. No.: 541,780

[22] Filed: Oct. 13, 1983

[51] Int. Cl.[4] ..... B63C 9/10

[52] U.S. Cl. ..... 441/111; 441/106; 441/115; 441/125

[58] Field of Search ..... 441/108, 111, 112, 114, 441/115, 125, 126, 127, 106; 2/74, 75, 80, 269, 67, DIG. 3

[56] References Cited

U.S. PATENT DOCUMENTS

| | | | |
|---|---|---|---|
| 286,660 | 10/1883 | Weil | 2/67 |
| 1,130,778 | 3/1915 | Waskin | 441/116 |
| 1,904,767 | 4/1933 | Nakamura | 441/111 |
| 2,008,773 | 7/1935 | Shapiro | 2/80 |
| 2,021,713 | 11/1935 | Borino | 441/128 |
| 2,359,843 | 10/1944 | Harris | 441/112 |
| 2,591,513 | 4/1952 | Cormier | 2/76 |
| 3,015,115 | 1/1962 | Medin | 441/115 |
| 3,110,903 | 11/1963 | Burchard | 2/76 |
| 3,665,516 | 5/1972 | Orovan | 2/269 |
| 3,771,169 | 11/1973 | Edmund | 2/2.1 R |
| 3,883,914 | 5/1975 | Blair | 441/112 |
| 3,895,396 | 7/1975 | Amarantos | 441/108 |
| 4,416,641 | 11/1983 | Spinosa et al. | 441/108 |

FOREIGN PATENT DOCUMENTS

| | | | |
|---|---|---|---|
| 115465 | 5/1918 | United Kingdom | 441/125 |

*Primary Examiner*—Trygve M. Blix
*Assistant Examiner*—Edwin L. Swinehart

[57] ABSTRACT

A swim-safe play suit is provided and consists of a plurality of substantially equi-spaced flexible waterproof buoyant elements arranged within upper portion of the play suit in parallel relation so that if wearer of the play suit enters water the wearer will not drown.

1 Claim, 7 Drawing Figures

SWIM SAFE PLAY SUIT

BACKGROUND OF THE INVENTION

The instant invention relates generally to buoyant garments and more specifically it relates to a swim-safe playsuit.

Unattended children and adults who cannot swim have drowned in pools, lakes, rivers and oceans. This said condition can be avoided if proper care can be taken. This situation is a serious problem so accordingly it is in dire need of an improvement.

Numerous buoyant garments have been provided in prior art that are adapted to keep the wearer afloat. For example U.S. Pat. Nos. 2,374,506; 2,897,821 and 3,094,724 all are illustrative of such prior art. While these units may be suitable for the particular purpose to which they address, they would not be suitable for the purpose of the present invention as heretofore described.

SUMMARY OF THE INVENTION

A principal object of the present invention is to provide a swim-safe play suit that contains waterproof buoyant elements so that if the wearer enters water the wearer will not drown.

Another object is to provide a swim-safe play suit that also serves as some insulation against heat.

An additional object is to provide a swim-safe play suit that is designed to be expandable so that if the wearer grows the wearer can still fit into the play suit.

A further object is to provide a swim-safe play suit that is simple and easy to use.

A still further object is to provide a swim-safe play suit that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claim.

BRIEF DESCRIPTION OF THE DRAWING FIGURES

DETAILED DESCRIPTION OF THE PREFERRED EMBODIMENTS

Figure 1:
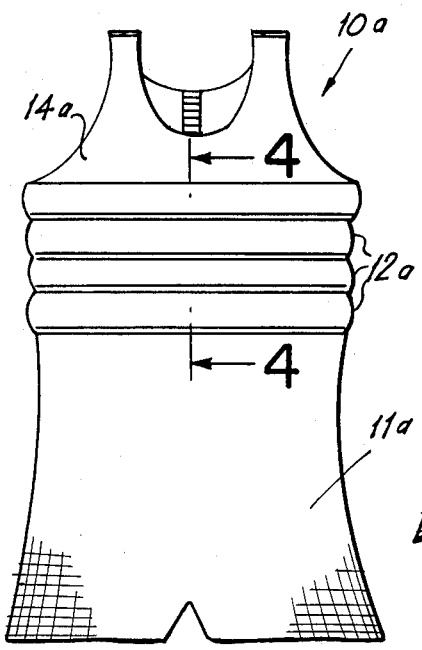
FIG. 1 is a front view of a male child garment utilizing the invention with horizontal ribs.
Figure 2:
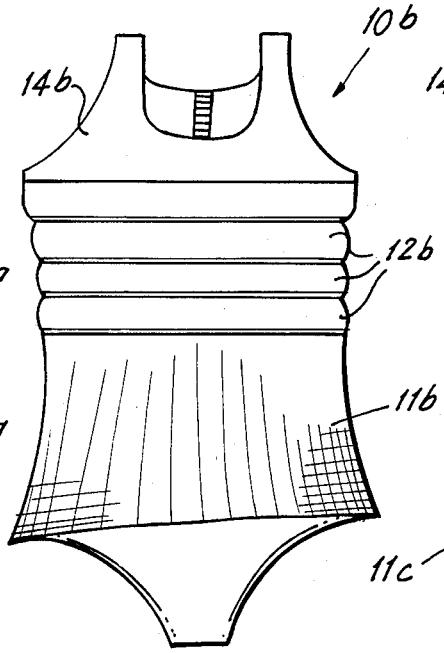
FIG. 2 is a front view of a female child garment utilizing the invention with horizontal ribs.
Figure 4:
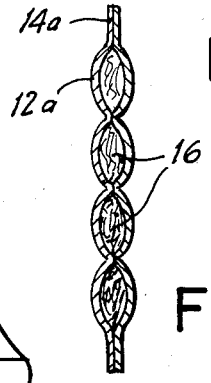
FIG. 4 is a cross sectional view taken along line 4—4 in FIG. 1.

Turning now descriptively to the drawings, in which similar reference characters denote similar elements throughout the several views, FIGS. 1 and 2 illustrates a swim-safe play suit 10*a* for a male child having short pants 11*a* and a swim-safe play suit 10*b* for a female child having a short skirt 11*b*. Both play suits 10*a* and 10*b* contain a plurality of substantially equi-spaced flexible waterproof buoyant elements 12*a* and 12*b* sewn within upper portion 14*a* and 14*b*, in a horizontal parallel relation. If a wearer of either play suit 10*a* and 10*b* enters water the wearer will not drown. The flexible waterproof buoyant elements 12*a* and 12*b* are styrofoam pellets 16 (see FIG. 4) that also serves as some insulation against heat.

Figure 3:
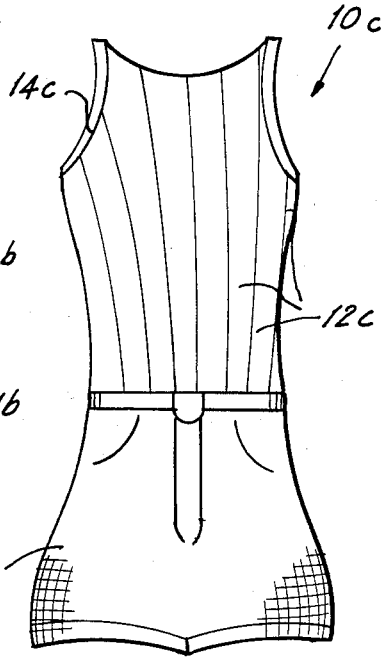
FIG. 3 is a front view of a female adult garment utilizing the invention with vertical ribs.

FIG. 3 shows a swim-safe play suit 10*c* for a female adult having a pair of shorts 11*c*. The substantially equi-spaced flexible waterproof buoyant elements 12*c* are arranged within upper portion 14*c* of the playsuit 10*b* in a vertical parallel relation.

Figure 5:
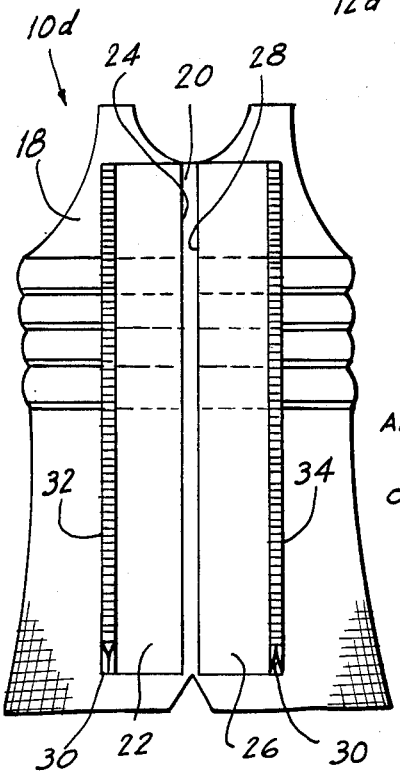
FIG. 5 is a rear view of the male child garment showing a first modification so that the garment can be expandable.

FIG. 5 shows a swim-safe playsuit 10*d* that contains a rear portion 18 that has a vertical slot 20 therethrough formed as follows; A first vertical strip of material 22 is sewn at right edge 24 adjacent left side of the vertical slot 20 thereby forming slot 20 between edges 24 and 28 on the playsuit material. A second vertical strip of material 26 is sewn at left edge 28 adjacent right side of the vertical slot 20. A zipper 30 is provided, one half of the zipper 30 is sewn to left edge 32 of the first vertical strip 22 and other half of the zipper 30 is sewn to right edge 34 of the second vertical strip 26. The play suit 10*d* can be expandable if the wearer grows whereby the wearer can still fit into the play suit 10*d*. A "Velcro" strip (not shown) can substitute the zipper 30 if so desired.

Figure 6:
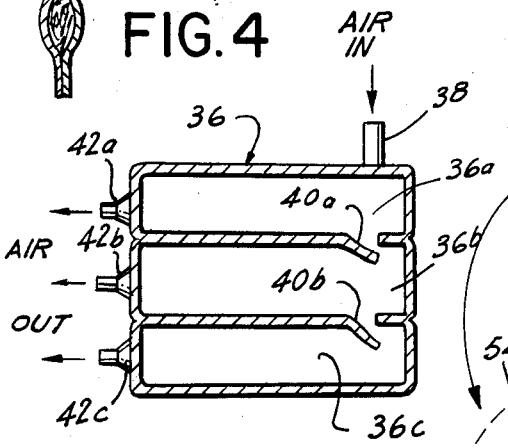
FIG. 6 is a cross sectional view of a second modification showing the garment being air filled.

FIG. 6 shows the flexible waterproof buoyant elements 12*a*, 12*b* or 12*c* as hollow air chambers 36. The hollow air chambers 36 contains an air intake valve 38 to allow forced air to enter a first hollow air chamber 36*a*. Two check valves 40*a* and 40*b* are provided. Check valve 40*a* is connected between hollow air chambers 36*a* and 36*b* while check valve 40*b* is connected between hollow air chambers 36*b* and 36*c* to allow air to fill all the hollow air chambers 36*a*, 36*b* and 36*c*. Three deflation valves 42, 42*b* and 42*c* are also provided. Deflation valve 42*a* is connected to hollow air chamber 36*a*, deflation valve 42*b* is connected to hollow air chamber 36*b* while deflation valve 42*c* is connected to hollow air chamber 36*c* to allow air to exit when each deflation valve 42*a*, 42*b* and 42*c* is activated. Three hollow air chambers 36*a*, 36*b* and 36*c* are shown but additional hollow air chambers can be connected to this system.

Figure 7:
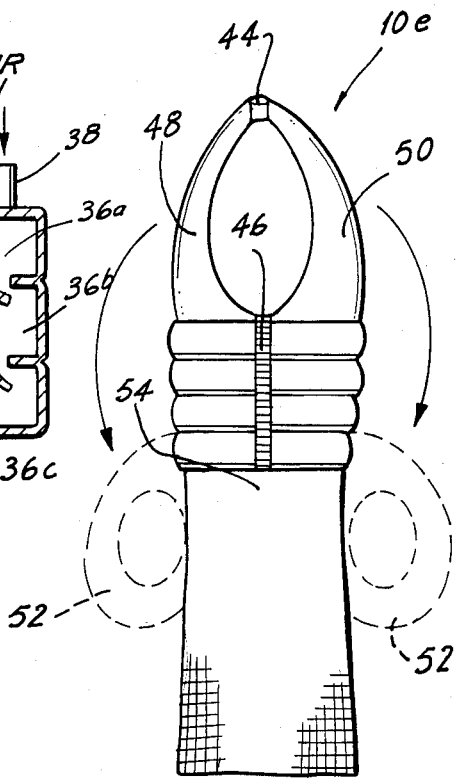
FIG. 7 is a side view of a third modification showing the invention being folded down to form a life preserver around the waist of the garment.

FIG. 7 shows another swim-safe play suit 10*e* that contains zippers or "Velcro" strips 44 and 46 for detaching front upper portion 48 from rear upper portion 50. The front upper portion 48 and the rear upper portion 50 can be folded down to form a life preserver 52 shown in dotted lines around the waist 54 of the play suit 10*e*.

While certain novel features of this invention have been shown and described and are pointed out in the annexed claim, it will be understood that various omissions, substitutions and changes in the forms and details of the device illustrated and in its operation can be made by those skilled in the art without departing from the spirit of the invention.

What is claimed is:

1. A buoyant swim suit having an upper portion and a lower portion, said upper portion having a plurality of substantially equi-spaced, parallel, flexible and waterproof hollow air chambers retained there within and shoulder portions extending over the shoulders of the wearer, said lower portion being comprised of ordinary swim suit material, said swim suit further comprising separable fastening means on said shoulder portions and respective sides of said upper portion to thereby form front and rear upper portions, whereby said front and rear upper portions can be rolled downward to form a life preserver about said wearer's mid section.

* * * * *